US006484353B2

(12) United States Patent
Rau

(10) Patent No.: US 6,484,353 B2
(45) Date of Patent: Nov. 26, 2002

(54) RIDING TYPE SWEEPER WITH REAR-MOUNTED ENGINE

(75) Inventor: Arthur Rau, Westerstetten (DE)

(73) Assignee: WAP Reinigungssysteme GmbH & Co., Bellenberg (DE)

( * ) Notice: Subject to any disclaimer, the term of this patent is extended or adjusted under 35 U.S.C. 154(b) by 0 days.

(21) Appl. No.: 09/848,964

(22) Filed: May 3, 2001

(65) Prior Publication Data

US 2001/0049856 A1 Dec. 13, 2001

Related U.S. Application Data

(63) Continuation of application No. PCT/EP99/08496, filed on Nov. 5, 1999.

(30) Foreign Application Priority Data

Nov. 10, 1998 (DE) ..... 198 51 681

(51) Int. Cl.[7] ..... E01H 1/05
(52) U.S. Cl. ..... 15/340.4; 15/349
(58) Field of Search ..... 15/349, 340.4

(56) References Cited

U.S. PATENT DOCUMENTS 3,006,021 A * 10/1961 Patch ..... 15/340.4
4,514,875 A 5/1985 Comer
4,979,260 A * 12/1990 Holsten et al. ..... 15/340.3
5,416,949 A 5/1995 Jute
5,901,409 A * 5/1999 Schick et al. ..... 15/340.3
5,940,929 A * 8/1999 Berg ..... 15/334

FOREIGN PATENT DOCUMENTS

| | | |
|---|---|---|
| DE | 1 225 684 | 9/1966 |
| DE | 1 658 383 | 11/1970 |
| DE | 9 421 472 | 11/1995 |
| EP | 0 476 483 | 3/1992 |
| EP | 0 857 239 | 8/1998 |
| FR | 1 165 589 | 10/1958 |
| WO | WO 00/28150 | 5/2000 |

OTHER PUBLICATIONS

Form PCT/18A/210

* cited by examiner

*Primary Examiner*—Chris K. Moore
(74) *Attorney, Agent, or Firm*—Christa Hildebrand; Norris McLaughlin & Marcus, P.A.

(57) ABSTRACT

A riding type sweeper with a rear-mounted engine and a driven sweeper roller located between the front axle and the rear axle, wherein the sweeper roller transports the dirt into a coarse dirt container disposed behind the sweeper roller, from which the fine dirt is suctioned off by a filter blower unit. The filter blower unit is arranged in the region before the rear-mounted engine in a vertically superpositioned arrangement, with the blower turbine together with the fine filter being arranged in a common box.

6 Claims, 2 Drawing Sheets

RIDING TYPE SWEEPER WITH REAR-MOUNTED ENGINE

This application is a continuation of PCT/EP99/08496 filed Nov. 5, 1999.

BACKGROUND OF THE INVENTION

1. Field of the Invention

The present invention relates to a riding type sweeper with a rear-mounted engine and a driven sweeper roller located between the front axle and the rear axle. The sweeper roller transports the dirt into a container for coarse dirt which is disposed behind the sweeper roller, from which the fine dirt is suctioned off by a filter blower unit.

2. Description of the Related Art

Such riding type sweepers are known, for example, from the subject matter described in PCT/WO 97/15731. This reference discloses a rear-mounted engine arranged vertically, having an upwardly projecting drive shaft that is flanged directly on a blower turbine which operates via a suction hose on a fine filter which is disposed in the rear section. However, this arrangement causes a disadvantageous weight distribution, because the fine filter dust remover and the associated suction channel leading to the coarse dirt container located in the rear section shifts the weight of the entire vehicle towards the rear. Moreover, the body of the vehicle is relatively high, since the blower which is also oriented vertically and has a suction hose attached to the top requires a corresponding overall height.

It is therefore an object of the invention to improve a riding type sweeper of the aforedescribed type so that the sweeper has a more advantageous weight distribution and a reduced height.

SUMMARY OF THE INVENTION

The object of the invention is solved in that the filter blower unit is arranged in the region before the rear-mounted engine in a vertically superpositioned arrangement and that the blower turbine together with the fine filter are arranged in a common box (24). In other words, one aspect of the invention is to propose a filter blower unit, in which the fine filter and the blower turbine are arranged in a common box and located in a vertically superpositioned arrangement in the region of the rear-mounted engine in front of the rear axle of the vehicle.

Advantageously, placing the direct connection of blower turbine fine filter in a common box, in which the drive for the blower turbine is also inserted, provides a compact construction. By arranging these components as a superpositioned assembly, any weight projecting over the rear section of the vehicle can advantageously be eliminated. In this arrangement, the filter blower unit can be vertically stacked directly before the rear-mounted engine in the space between the front axle and the rear axle.

Further advantageously, by flanging the filter blower unit directly to the coarse dirt container, a suction channel between the fine filter and the coarse dirt container as well and a fine dust container can be eliminated. This reduces both the manufacturing cost and the weight of the vehicle, while at the same time improving the distribution of the space.

A cleaning device can be used to remove from the fine filter the dirt that is drawn in by the fine filter, with the removed dirt being returned to the coarse dirt container.

The overall height is also reduced and the device made more compact by arranging the vertical drive shaft of the rear-mounted engine so that it projects vertically downwardly. The drive shaft can thereby distribute the drive power to all the drives of the various components that are to be driven. This eliminates an upwardly projecting drive shaft which would otherwise increase the overall height.

One embodiment of the invention is directed toward achieving a compact construction with a low overall height. This embodiment is realized in that the fine dust container filter blower unit is arranged sequentially horizontally in the rear section of the vehicle and that the blower turbine with the fine filter and the fine dust container are arranged in a common box. This also makes the design compact, because the blower turbine, fine filter and fine dust container are located in a common box. This embodiment eliminates the suction hose between a blower turbine located remote from the fine filter, which would otherwise be required.

As mentioned above, the fine dust container filter blower unit is arranged in the rear section of the vehicle; however, the rear-mounted engine is not located above the rear axle, but rather slightly in front of the rear axle for optimizing the weight distribution on the rear axle. This embodiment also provides a compact construction by positioning the drive for the blower turbine in the space between the blower turbine and the fine filter and fine dust container and providing a pulley that is connected through an angle drive with the downwardly projecting drive shaft of the rear-mounted engine.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
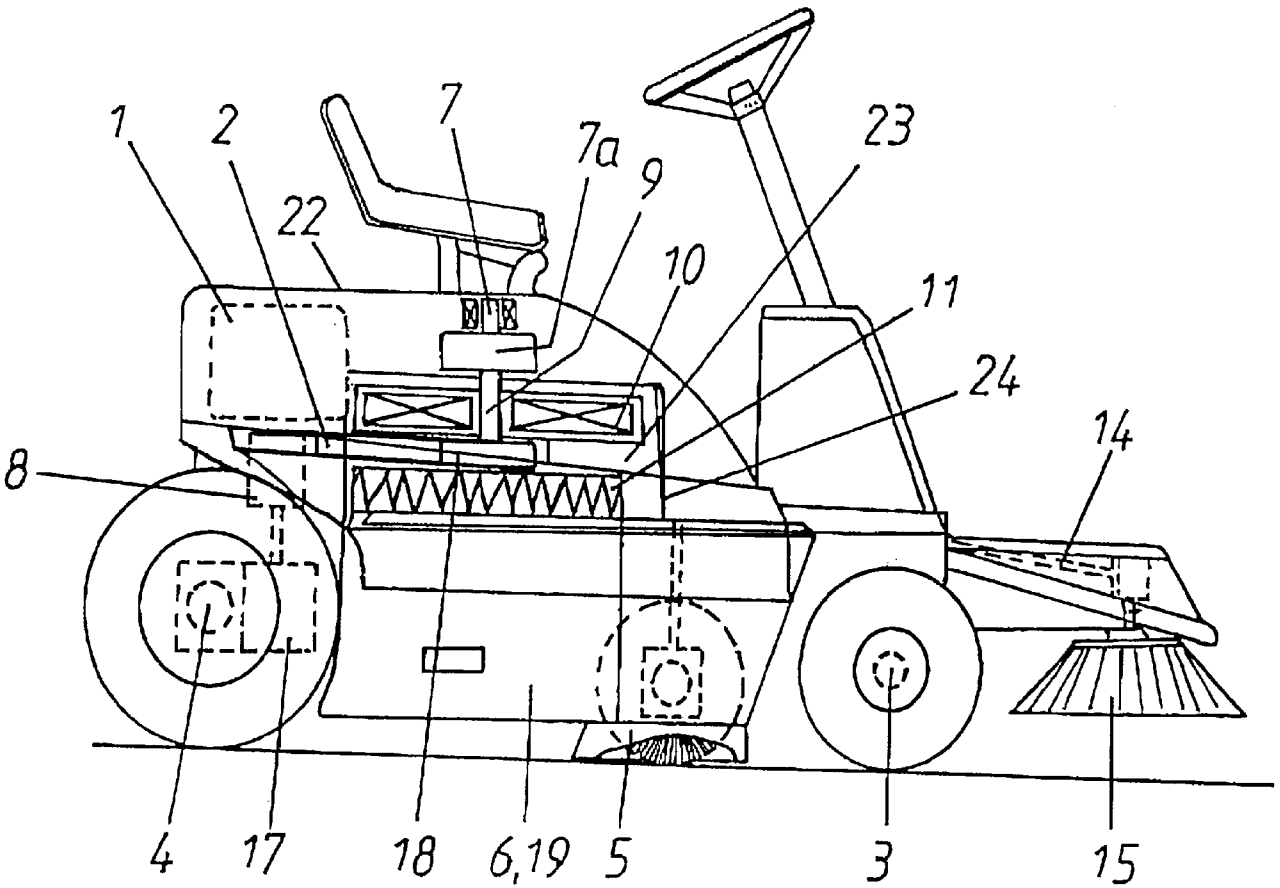
FIG. 1 shows schematically a side view of a first embodiment of a riding type sweeper.

The riding type sweeper of FIG. 1 includes a chassis with a front axle 3 and a rear axle 4, wherein a rear-mounted engine is arranged in an area approximately in front of the rear axle. The engine has a downwardly projecting drive shaft cooperating with an angle drive 8, with the angle drive 8 driving the rear axle 4 of the vehicle via another angle drive 17. A belt drive 2, which is capable of driving a blower turbine 10 and also the sweeper roller 5 and the side brushes 15, is powered by the angle drive 8.

The side sweeping brushes 15 are driven by a dedicated belt drive 14, which derives power from the angle drive 8. The sweeper roller 5 is driven in a counter-clockwise rotation direction and transports the collected dirt and throws the dirt overhead into a coarse dirt container 6 located between the front axle 3 and the rear axle 4. From this container, the generated fine dust is directly suctioned off in an upward direction and passes through a fine filter 11 which is flanged directly to the coarse dirt container 6. Accordingly, the entire surface area of the fine filter 11 is part of the surface area that covers the coarse dirt container 6. This produces an extremely effective dust separation.

A drive with a pulley 18 for driving the drive shaft 9 of the blower turbine 10 is arranged in the outlet flow direction following the fine filter 11. The blower turbine 10 is located in the exhaust flow direction after the fine filter 11. The drive shaft 9 is suspended from one side in two sequentially arranged bearings 7, 7*a*.

The coarse dirt container 6 is also formed as a drawer 19 which can be pulled out and pushed in perpendicular to the drawing plane of FIG. 1.

A cleaning device associated with the fine filter 11 and adapted for occasionally cleaning the fine filter is not shown in the drawings.

It is important that the blower turbine 10 and the fine filter are located in a common box 24 that surrounds the two assemblies, thereby achieving a compact, space-saving construction. The pulley 18 which drives the blower turbine 10 is located in the space 23 between the two assemblies.

Figure 2:
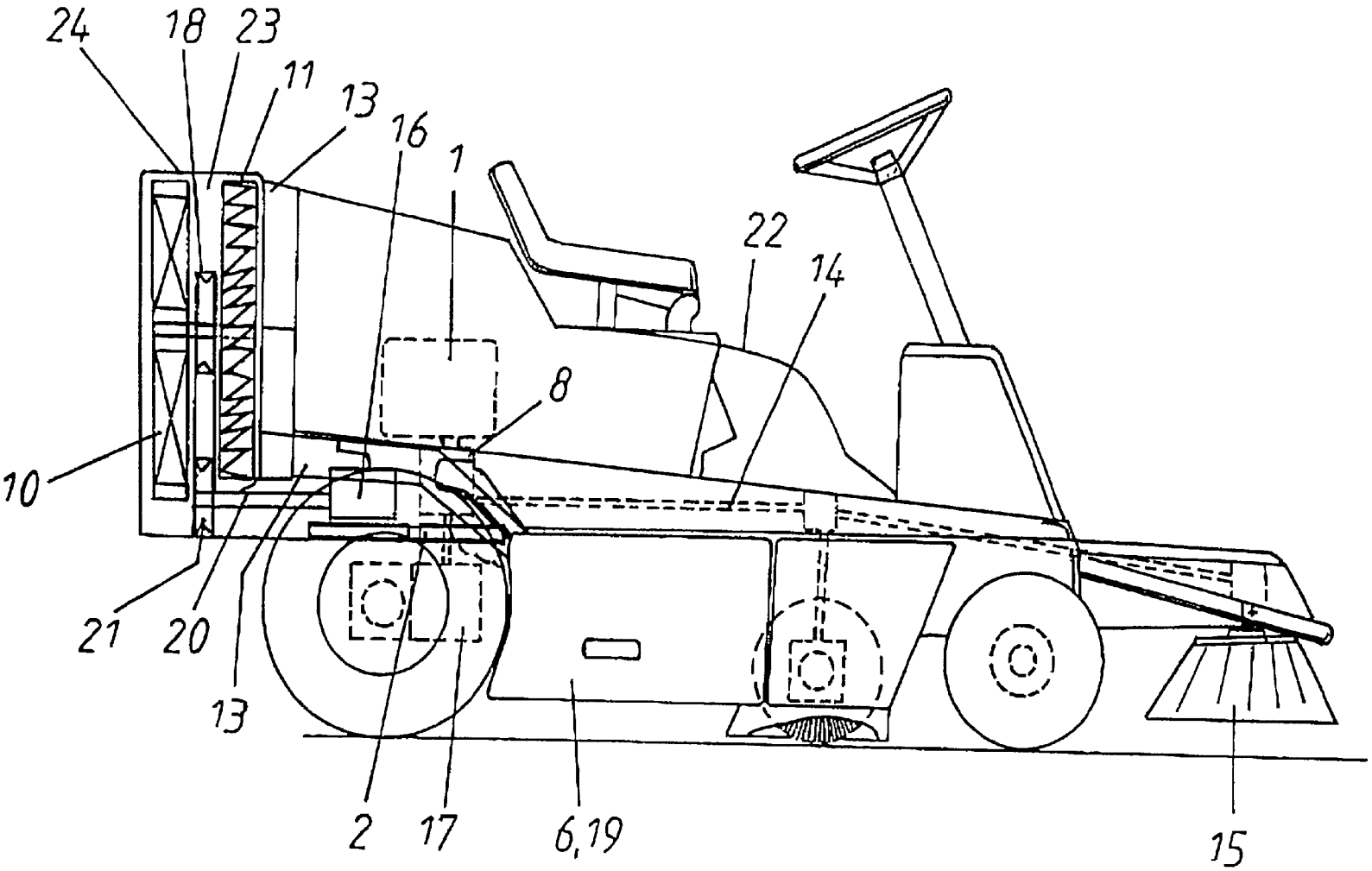
FIG. 2 shows schematically a side view of a second embodiment of a riding type sweeper.

The embodiment of FIG. 2 is similar to the embodiment of FIG. 1 in that a rear-mounted engine also drives a filter blower unit 10 and 11. However, in the embodiment of FIG. 2, the filter blower unit 10, 11 is arranged in the rear section of the vehicle and oriented horizontally. The blower turbine 10 is again driven by a pulley 18, located in the space 23 between the two assemblies 10, 11. The pulley 18 in turn is driven by a pulley 21 located underneath, which is connected with a drive shaft 20 and secured against rotation relative to the drive shaft 20. The drive shaft 20 is connected to an intermediate gear 16 which is driven by the rear-mounted engine 1.

It will be understood that the aforedescribed angle drive 8 of the rear-mounted engine 1 can also be combined with the intermediate gear 16. An important aspect of this embodiment is that the fine filter 11 and the blower turbine 10 are also located in a common box 24.

The low overall height of the entire vehicle is depicted in FIG. 1 which shows that a cover 22 can be placed at a low height across all assemblies 1, 10, 11 that are combined in the region between the front axle and the rear axle.

The same can be seen from FIG. 2, where a low overall height is also achieved by eliminating the upwardly projecting drive shaft of the rear-mounted engine which would increase the overall height.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A riding type sweeper vehicle for sweeping dirt, having a rear-mounted engine, the sweeper comprising:

a front axle and a rear axle;

a driven sweeper roller disposed between the front axle and the rear axle;

a coarse dirt container disposed adjacent to the sweeper roller; and the sweeper roller being designed such as to transport coarse and fine dirt into the coarse direct container;

a common box configured to house a filter blower unit comprising a blower turbine and a fine filter, the filter blower unit is arranged in front of the rear-mounted engine, and the blower turbine and fine filter being arranged vertically relative to one another in the common box;

the filter blower is designed such as to suction off the fine dirt from the coarse dirt container.

2. The riding type sweeper vehicle according to claim 1, wherein the blower turbine is driven by a belt drive powered by the rear mounted engine and the blower turbine has a drive shaft driven by a pulley, the pulley being accommodated in a space located between an outlet side of the fine filter and an inlet side of the blower turbine.

3. The riding type sweeper vehicle according to claim 1, wherein the filter blower unit is located above the coarse dirt container.

4. A riding type sweeper vehicle for sweeping dirt, having a rear-mounted engine, engine, the sweeper comprising:

a front axle and a rear axle;

a driven sweeper roller disposed between the front axle and the rear axle;

a coarse dirt container diposed adjacent to the sweeper roller;

the sweeper roller being designed such as to transport coarse and fine dirt into the coarse dirt container;

a common box configured to house a filter blower unit comprising a blower turbine and a fine filter, the filter blower unit is disposed behind the rear-mounted motor, and the blower turbine and the fine filter being arranged sequentially in a horizontal direction with respect to each other in the common box; and the filter blower is designed such as to suction off the fine dirt from the course dirt container.

5. The riding type sweeper vehicle according to claim 1, wherein the riding type sweeper vehicle includes side brushes and wherein the rear-mounted engine includes a single, vertically downwardly projecting drive shaft which drives the sweeper roller, the side brushes and the filter blower unit.

6. The riding type sweeper vehicle according to claim 4, wherein the riding type sweeper vehicle includes side brushes and wherein the rear-mounted engine includes a single, vertically downwardly projecting drive shaft which drives the sweeper roller, the side brushes and the filter blower unit.

* * * * *